United States Patent [19]

Hauser

[11] 4,296,515

[45] Oct. 27, 1981

[54] FASTENING OF SHOE UPPERS FOR LASTING

[76] Inventor: John Hauser, Calle Chama, Qta. Tony, Colinas de Bello Monte, Caracas 101, Venezuela

[21] Appl. No.: 157,717

[22] Filed: Jun. 9, 1980

[51] Int. Cl.[3] ..... A43D 5/00; A43D 9/00

[52] U.S. Cl. ..... 12/142 LC; 12/113

[58] Field of Search ..... 12/142 LC, 113

[56] References Cited

U.S. PATENT DOCUMENTS

| | | | |
|---|---|---|---|
| 1,274,700 | 8/1918 | Fernald | 12/142 LC |
| 3,131,490 | 5/1964 | Rowen | 12/113 |
| 4,094,029 | 6/1978 | Carlile | 12/113 |

*Primary Examiner*—Patrick D. Lawson

*Attorney, Agent, or Firm*—Jordan and Hamburg

[57] ABSTRACT

A process for temporarily fastening the flaps of shoe uppers for a lasting step includes aligning pairs of opposed eyelets of the flaps, propelling one of a pair of substantially parallel legs of each of a plurality of generally U or H shaped fastening element through respective pairs of the aligned opposed eyelets and positioning the thus prepared upper on a last for a lasting operation. The substantially parallel legs of the fastening elements serve to maintain the flaps in connected relationship and are readily removed from the eyelets by severing of a bridge element which extends between and connects the legs.

6 Claims, 7 Drawing Figures

FIG. 1
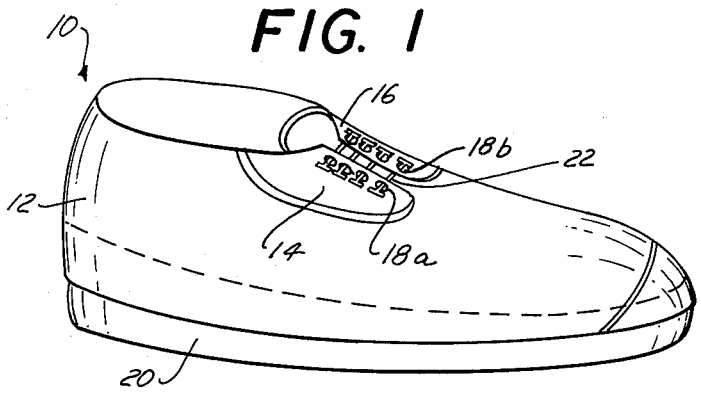
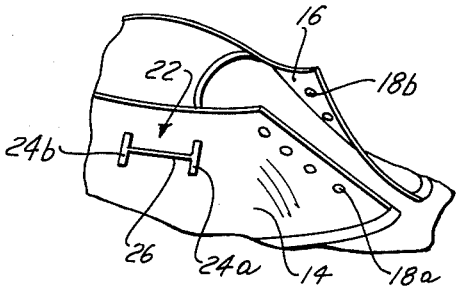
FIG. 2A
FIG. 2B
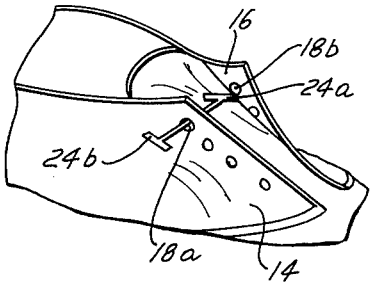
FIG. 2C
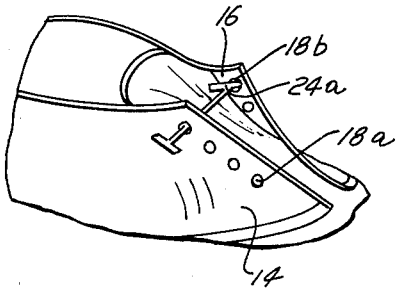

FASTENING OF SHOE UPPERS FOR LASTING

BACKGROUND OF THE INVENTION

The present invention relates generally to the manufacture of lasted shoes and more particularly to an improved manner of temporarily fastening the flaps of uppers, provided with opposed rows of eyelets, for the lasting operation.

It has been conventional in the field of shoe manufacturing to fasten the uppers of the shoe to the sole in a lasting operation during which time the uppers are positioned over a last for attachment to the shoe sole in a predetermined configuration depending upon style considerations. During the lasting step the uppers are stretched over the last and are subjected to various stresses which, unless adequately compensated for, commonly result in a lasted shoe in which such uppers are deformed so that they do not possess the intended shape. Thus, the carefully created aesthetic appearance of the shoe will not have been attained. Further, unless the uppers are maintained in proper relationship to the sole during the lasting operation there is the possibility of improper securement of the sole to the upper and the consequent production of a defective shoe.

In the manufacture of lasted shoes of the type in which the uppers comprise a pair of flaps having respective sets of eyelets by means of which the shoe is laced over the instep of the foot the flaps are temporarily fastened during the lasting step. In this manner the correct relationship between upper and sole and the configuration for the uppers can be maintained during lasting. In this connection it has been conventional to fasten the flaps in such correct relative position by the use of temporary lacing or twine or through the use of various other fastening devices. The following patents disclose representative prior techniques and devices for maintaining the uppers in correct position during the lasting operation:

- U.S. Pat. No. 234,488 issued Nov. 16, 1880 to McKay & Fairfield
- U.S. Pat. No. 657,852 issued Sept. 11, 1900 to E. E. Canedy
- U.S. Pat. No. 688,297 issued Dec. 10, 1901 to W. E. Ellis
- U.S. Pat. No. 3,131,490 issued May 5, 1964 to T. C. Rowen Although the expedients adopted by the prior art, such as exemplified by the disclosures in the aforesaid patents, have proven to be generally satisfactory insofar as maintenance of the uppers in proper positional relationship is concerned, they have, by and large, failed to alleviate the bottleneck thus created at the end of the production line. In many instances use of temporary lacing has necessitated resort to manual labor in connection with the fastening and/or unfastening of the flaps of the uppers leading to varying degrees of slowdowns on the production line. Even the use of relatively expensive machinery, particularly with forms of fastening devices other than temporary lacing, has failed to clear the production line of the bottleneck immediately prior to and subsequent to the lasting operation attributable to the fastening and unfastening of the flaps of the uppers. There has, therefore, been an ongoing need for an expeditious and inexpensive manner of effecting the temporary fastening and then the unfastening of the upper flaps prior to and subsequent to the lasting operation.

SUMMARY OF THE INVENTION

In view of the foregoing it is the principal object of the invention to provide a process for temporarily fastening the flaps of shoe uppers prior to a lasting operation and for the unfastening of such flaps subsequent to lasting which occasions a minimum of manual labor.

It is another object of the invention to provide a process for the temporary fastening of eyeletted shoe uppers for positioning on a last and for the unfastening of the uppers subsequent to lasting utilizing expendable fastening elements which avoids the need for relatively complex machinery.

It is yet another object of the invention to provide a process for the temporary fastening of eyeletted shoe uppers for a lasting operation and for the unfastening of such uppers after lasting which is readily adaptable to automatic operation with relatively simple apparatus.

Other objects and advantages of the invention will become readily apparent to persons having ordinary skill in the art to which the invention pertains from the ensuing description of the invention.

In accordance with the invention there is provided a process for temporarily fastening the flaps of shoe uppers for a lasting operation which comprises aligning pairs of opposed eyelets formed in the flaps and propelling one of a pair of substantially parallel legs of a fastening element, having a bridging element extending between and connecting such legs, through the pairs of aligned eyelets. The thus prepared upper is thereafter positioned on a last and undergoes lasting. The fastening elements, subsequent to the lasting operation, can be removed by severing the bridging elements and withdrawing the legs from the eyelets.

BRIEF DESCRIPTION OF THE DRAWINGS

In order that the invention may be more fully comprehended it will now be described, by way of example, with reference to the accompanying drawings in which:

FIG. 1 is a perspective view of an eyeletted shoe upper which has the flaps thereof temporarily fastened for lasting and which is shown positioned on a last;

FIGS. 2 *a–c* are fragmentary perspectively views of the shoe upper shown in FIG. 1 in the successive stages of fastening element application in accordance with the invention;

DESCRIPTION OF THE PREFERRED EMBODIMENTS

Figure 3:
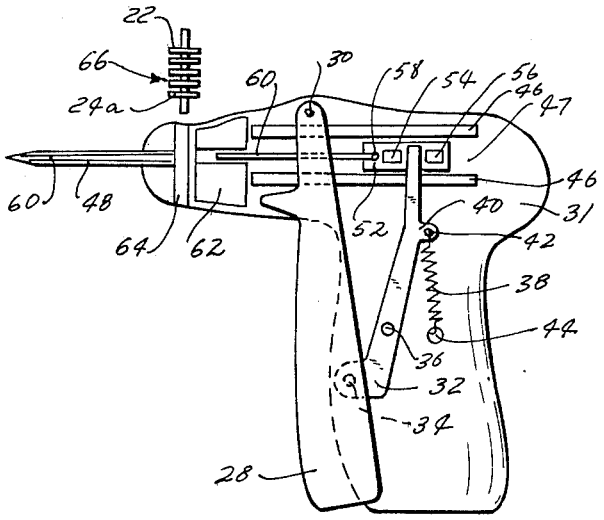
FIG. 3 is a schematic view of an apparatus suitable for use in temporarily fastening the flaps of the shoe upper shown in FIGS. 1 and 2.

Before explaining the invention in detail it is to be understood that the invention is not limited in its application to the specific details of construction and arrangement of parts illustrated in the drawings since it is capable of other embodiments and of being practiced or carried out in various ways. It is also to be understood that the phraseology or terminology employed is for the purpose of description only and not of limitation.

Referring to the drawings in which like reference numerals designate like elements throughout the various views, and particularly referring to FIG. 1 thereof, there is shown a shoe upper 10 consisting basically of a lower body portion 12 and a pair of flaps 14, 16. The flaps extend generally along the instep line and are given parallel rows of eyelets 18 which, when the shoe is laced, serve to secure the shoe to the foot of the wearer thereof.

In the manufacture of shoes, as stated earlier, the upper 10 is positioned upon a last, identified in FIG. 1 by reference numeral 20, for attachment of the upper to the sole of the shoe (not shown). The crux of the present invention resides in the manner by which the flaps 14, 16 may be temporarily fastened so as to maintain the upper in proper orientation on the last during the lasting step and in the manner by which the flaps may be unfastened subsequent to the lasting operation.

In FIG. 3 there are shown the basic components for an apparatus, referred to in the present specification as a gun, for temporary fastening of the flaps. FIGS. 2 a–c illustrate the stages which are undergone by a fastening element during application of the fastening elements to the eyelets by means of such a gun. Guns of the type depicted schematically and currently commercially available as are the fastening elements employed therewith. One such gun is marketed under the trade name ONE TACHER and is useful in connection with the affixing of price and size tags and labels to various items of wearing apparel such as sweaters, shirts, jackets, etc. However, the present use of the gun and fastening elements is rather different from the use disclosed herein, the use in accordance with the present invention involving considerations completely foreign to the current field of use of such guns and fastening elements thereby resulting in advantages which would not normally occur to persons having ordinary skill in the art to which this invention appertains. Thus, heretofore such guns and fastening elements have been used to "shoot" the fastening element through the tag and fabric of the item at any convenient location. Usually the same location on each like item is selected as the site for attachment of the tag. There is no need to align adjacent layers of the material of the item prior to shooting. In practice it is preferable to shoot the fastening element through only a single layer of the material in order to facilitate both securement and subsequent separation of the fastening element and tag from the item.

Underlying the present invention is a recognition that the problem encountered at the end of the production line in the manufacture of lasted shoes, due to the steps of temporarily fastening the flaps of the upper prior to lasting and in unfastening such flaps after lasting, can be readily overcome by employment of a commercially available gun and fastening element in a unique fastening process.

Figure 4:
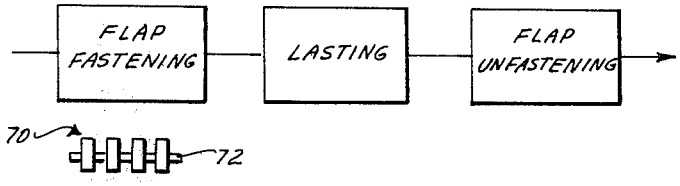
FIG. 4 is a schematic view of a battery of flap fasteners for use in temporarily fastening the flaps of a shoe upper in accordance with the invention.

Referring to FIG. 1 and to FIGS. 2 *a–c* it will be observed that the upper 10 of the shoe is arranged so that the pairs of opposed eyelets 18*a*, 18*b* are brought into substantially horizontal alignment. A fastening element 22 is placed in a gun as will be hereinafter described and shot through each pair of aligned eyelets. It will, of course, be appreciated that a single gun can be employed to shoot fastening elements in sequence through each succeeding pair of aligned eyelets or a battery of guns can be positioned relative to the upper such that all of the eyelets are shot with fastening elements simultaneously. The latter embodiment of the invention can be practiced with the apparatus arranged as shown in FIG. 4.

Turning to FIGS. 2 *a–c* it will be seen that the fastening element 22 comprises a pair of substantially parallel legs 24*a*, 24*b* and a bridging element 26 which extends between the legs and interconnects same. The fastening element presently in use is usually fabricated from a synthetic plastics material of relatively low cost. It should possess sufficient ridigity, at least the leg to be shot through the eyelets, such that it will be propelled through the eyelets and will not buckle under the propelling force. Such rigidity may be obtained by a suitable selection of the type of material and/or by the dimensions of the leg. The legs should also possess adequate strength such that when the upper is positioned on the last and is subjected to the lasting operation they are capable of withstanding the stresses encountered by the upper during lasting and will remain sufficiently rigid so as not to be drawn through the eyelets so as to prematurely result in an unfastening of the flaps.

FIG. 2*a* shows the fastening element prior to entry through the first of the aligned eyelets. FIG. 2*b* illustrates the legs 24*a* having passed through the first of the aligned eyelets and about to pass through the second of such aligned eyelets. FIG. 2*c* depicts the leg 24*a* of the fastening element partially through the second aligned eyelet before adopting the position shown in FIG. 1. The leg 24*a* thus initially is propelled in a direction substantially normal to the plane of the eyelets, although the exact angular relationship between the path of the leg and the plane of the eyelets can vary somewhat; then, after passing through the second eyelet, the leg 24*a* springs into an orientation which is substantially parallel to the plane of the eyelets 18*b*.

Referring now to FIG. 3 there is shown a suitable apparatus in the form of a gun for propelling fastening elements through the eyelets 18 of the shoe upper. Basically the gun includes a trigger member 28 which is pivotable about a pin member 30 carried within a housing 31. An actuating member 32 is mounted on the trigger 28 by means of a pin 34 such that the lower end of the actuating member 32 moves with the trigger. The actuating member 32 has an intermediate portion thereof positioned for rotation about a pivot pin 36 of the housing 31. A coil spring 38 is interposed between a shoulder 40 projecting from an upper portion of the actuating member 32, and a pin 44 of the housing 31. An end of the spring 38 is situated in a hole 42 of the shoulder 40, while the other end is directly connected to the pin 44. In the housing of the gun at a location spaced from the end of spring 38 carried by the actuating member 32 and adjacent to the upper portion of the actuating member there are provided two guide walls 46 to define a guide channel 47. An end of the housing is given a needle element 48 which is hollow for a purpose to be described. Further, needle 48 is slotted with an axially extending slot 50 which also serves a function to be explained. The guide channel 47 is arranged within the housing so as to be axially aligned with needle 48. A carriage 52 is provided which is slidable within the guide channel 47. Integral with the carriage 52 are a pair of longitudinally spaced lugs 54, 56 and a hole 58 is also provided at a front end of the carriage 52. A rod-type plunger 60 has one end thereof anchored in the hole 58 so that the plunger 60 is reciprocable together with the carriage 52. The plunger 60 is guided within the housing 31 by appropriate guide means 62 so that the end remote from the carriage 52 will enter the hollow needle 48. The upper extremity of the actuating member 32 projects between the lugs 54, 56 of the carriage 52. Thus, as the trigger 28 is depressed it pivots about the pin 34 causing the actuating member 32 to pivot about the pin 36. The upper portion of the actuating member 32 and its upper extremity moves to the left (as viewed in FIG. 3) engaging with the lug 54 and propelling the carriage 52 to the left so as to move the plunger 60 through the needle 48. The spring 38 is thus tensioned and readied for a return of the upper portion of actuating member 32 to its initial position upon completion of the forward movement of the carriage 52 and the plunger rod 60.

There is provided within the housing a slot 64 for reception of the fastening elements 22. The fastening elements may be provided in the form of a series of connected elements formed as a clip assembly 66 insertable into the slot 64 with the lowermost leg of a fastening element constituted by the leg 24*a*. When the trigger 28 is actuated to move the carriage 52 and the plunger rod 60 forwardly, the plunger rod 60 engages with the leg 24*a* of the clip assembly 66 and forcibly moves the leg 24*a* forwardly so that the lowermost fastening element is served from the clip assembly and is propelled forwardly. The leg 24*a* is forced through hollow needle 48, bridging element 26 passing through the slot 50 of the needle. Needle 48 is, of course, brought into alignment with the eyelets 18*a* and 18*b* so as to insure direction of the leg 24*a* therethrough. The path of the leg 24*a* has been previously described as it passes through the eyelets 18*a* and 18*b* and need not be further explained. Upon release of the trigger when the carriage completes its forward motion and the fastening element is propelled through the eyelets, spring 38 acting upon shoulder 40 of the actuating member 32 returns the trigger and carriage to their initial position. Although a typical gun has been described it will, of course, be understood that other guns may be utilized. For example, it is within the contemplation of the invention to employ a pneumatically propelled gun which need not have a trigger and trigger-controlled actuating member. The pneumatically operated gun may be electrically actuable through the use of limit switches and other appropriate and known control elements. However, it is presently preferred that a gun of the type illustrated and described by used by a person at the station of the production line where lasting is to be performed or at a location in advance of such station.

In FIG. 4 there is depicted a group of guns 70 for discharging a plurality of the fastening elements 22 simultaneously through a series of aligned pairs of eyelets 18. It will be appreciated that by employing a group or battery of guns all of the eyelets of an upper may be provided with fastening elements in a single operation. The guns may all be of the type described and the triggers actuated by means of a bar 72 extending across all of the triggers or, alternatively, another type of a gun such as a pneumatically operated apparatus may be used.

Although not illustrated, there is desirably provided means for mounting the upper so as to facilitate alignment of the pairs of eyelets for insertion of the fastening elements. Means such as those presently employed are suitable and it will be recognized that the particular type of mounting or holding means is not critical to the present invention.

Figure 5:
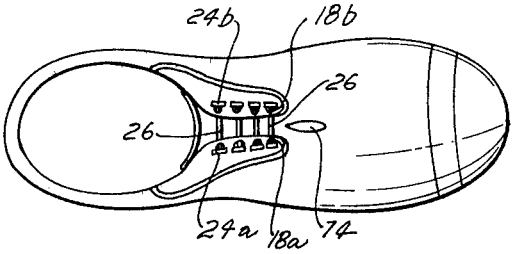
FIG. 5 is a top plan view of the shoe upper shown in FIG. 1 in an intermediate stage of flap separation subsequent to the lasting operation.

Referring to FIG. 5 it will be seen that subsequent to the lasting operation the fastening elements are removed from the upper. In a latter stage the finished shoe may be provided with laces; however, this step is left to the discretion of the shoe manufacturer and need not be described herein. As depicted in FIG. 5 the fastening elements may be removed by simply severing the bridging element 26 with a knife edge 74 and then withdrawing the legs 24*a*, 24*b* from the eyelets 18*a*, 18*b*. This step may be performed manually or, alternatively, a stationary knife edge may be positioned at the end of the lasting station and the shoe advanced so that the fastening elements are severed sequentially. In another embodiment the knife edge may be pivotably mounted and brought into position for severing of the bridging elements 26 either manually or automatically. The constructional details for any of such alternatives will be within the skill of the ordinary mechanic in the field to which the invention pertains.

From the foregoing it will be recognized that the invention affords a practicable solution to the problem created at the end of the production line where lasting is to be performed, substantially eliminating the down time of the production line while the uppers are temporarily fastened for lasting and subsequently unfastened. An advantage of the invention is that presently available fastening elements and guns for use therewith may be employed without resort to the design of special machinery. However, as stated above, it is within the ambit of the invention to provide more sophisticated fastening element propelling apparatus in order to increase the rapidity of the upper fastening and unfastening steps.

While the invention has been described by reference to specific embodiments thereof, it is to be understood that the definition of the invention as appears in the appended claims is to be construed as including all modifications, variations and alternatives which would be obvious to one having ordinary skill in the art.

What is claimed is:

1. A process for the temporary fastening of the flaps of a shoe upper prior to lasting of the upper, comprising aligning pairs of opposed eyelets formed in said upper, propelling fastening elements including a pair of substantially parallel legs and a bridging element extending between and connecting said legs through said aligned eyelets such that one of said legs of each fastening element passes through both aligned eyelets following a path which is generally normal to the planes of said eyelets until it passes through the second of the aligned eyelets and then adopts a disposition generally parallel to said second eyelet, the legs of said fastening elements thereafter preventing separation of said flaps beyond a predetermined distance established by the length of the bridging elements.

2. A process according to claim 1, wherein the thus fastened upper is passed to a lasting step for attachment to a shoe sole.

3. A process according to claim 1, wherein said fastening elements are fabricated from a synthetic plastics material.

4. A process according to claim 1, wherein said fastening elements are fabricated in the form of a plurality of interconnected elements and are fed to an apparatus for serial propulsion through said aligned eyelets.

5. A process according to claim 1, wherein fastening elements are propelled through a plurality of aligned eyelet pairs substantially simultaneously.

6. A process according to claim 1, wherein said bridging element has sufficient flexibility to permit said one leg of each fastening element to follow said path and itself to follow a path in which it is shifted from a disposition substantially parallel to said aligned pairs of eyelets to a disposition substantially normal thereto.

* * * * *